United States Patent [19]

Breitenstein et al.

[11] 4,036,242

[45] * July 19, 1977

[54] HOPPER PAYOUT FOR VARIOUS COIN DENOMINATIONS

[75] Inventors: Charles T. Breitenstein, Elk Grove Village; Frank G. Nicolaus, Chicago, both of Ill.

[73] Assignee: Spiral Step Tool Company, Elk Grove Village, Ill.

[ * ] Notice: The portion of the term of this patent subsequent to Mar. 9, 1993, has been disclaimed.

[21] Appl. No.: 640,631

[22] Filed: Dec. 15, 1975

Related U.S. Application Data

[63] Continuation of Ser. No. 384,624, Aug. 1, 1973, Pat. No. 3,942,544.

[51] Int. Cl.[2] ..... G07D 3/14; G07D 9/00

[52] U.S. Cl. ..... 133/4 R; 194/2

[58] Field of Search ..... 133/1, 2, 3, 4, 5, 8; 194/2

[56] References Cited

U.S. PATENT DOCUMENTS

| | | | |
|---|---|---|---|
| 2,675,007 | 4/1954 | Young et al. | 133/3 R |
| 3,285,380 | 11/1966 | Sykes | 194/2 |
| 3,942,544 | 3/1976 | Breitenstein et al. | 133/4 R |

*Primary Examiner*—Stanley H. Tollberg

*Assistant Examiner*—Joseph J. Rolla

*Attorney, Agent, or Firm*—Dominik, Knechtel, Godula & Demeur

[57] ABSTRACT

A hopper payout for various coin denominations is disclosed having a hopper, a rotary pin wheel, removably secured shelf wheel, and delivery opening in which the pin wheel is suspended for rotation by means of rollers oriented at the periphery of the wheel on spaced centers. The shelf wheel is removable and replaceable with differing diameter shelf wheels to accommodate varying denominations of coins. A centrally disposed agitator is similarly removable and interchangeable. The knife which removes coins from the shelf wheel is pivotally mounted to accommodate varying diameters of the varying coin dimensions. A uniformly widening coin gutter is provided to reduce the tendency of the coins to jam and shingle, irrespective of denomination and size. In order to adjustably accommodate the varying weights of coins within the hopper to divert the flow of coins into the permanent coin reservoir, the hopper is pivotally secured to the frame, and a yieldable means having a preselected resiliency secures the same against pivoting. Thus an empirical determination of the number of coins to be held in the hopper before bypassing to the permanent collection member can be made by service personnel in the field.

11 Claims, 19 Drawing Figures

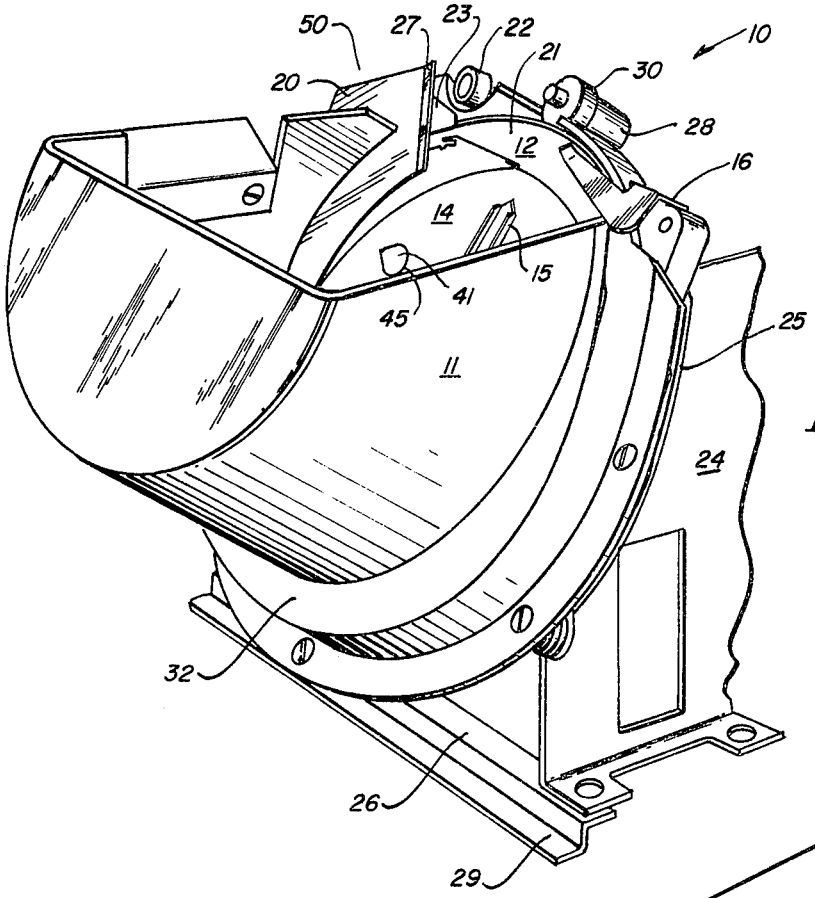
FIG. 1
FIG. 2
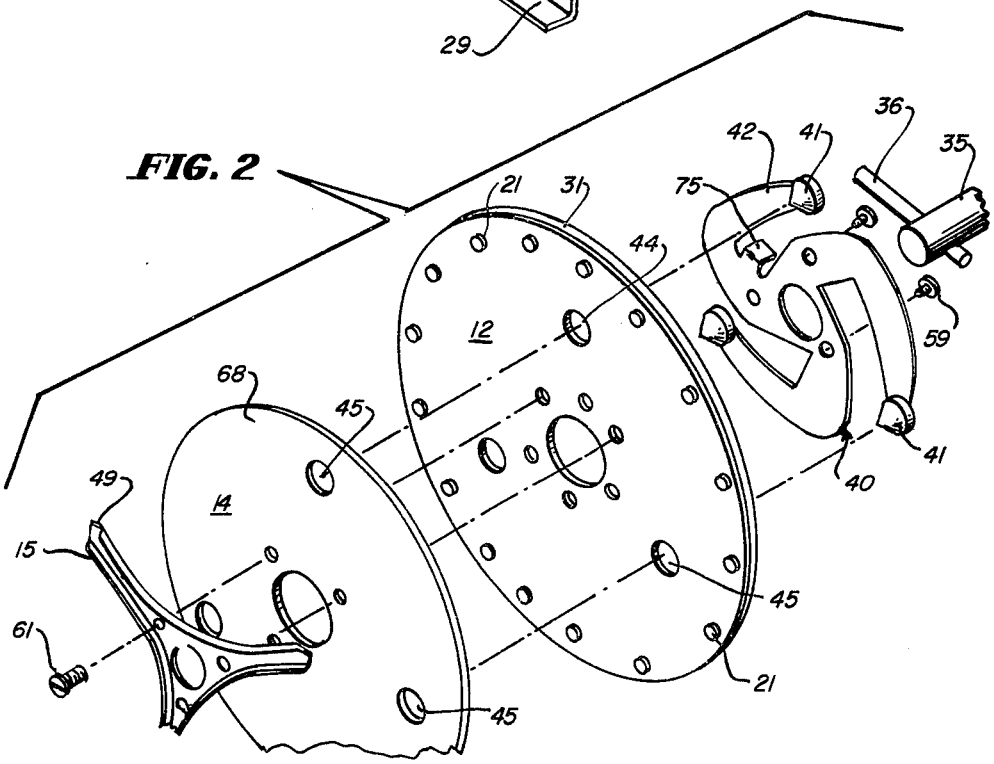

FIG. 3
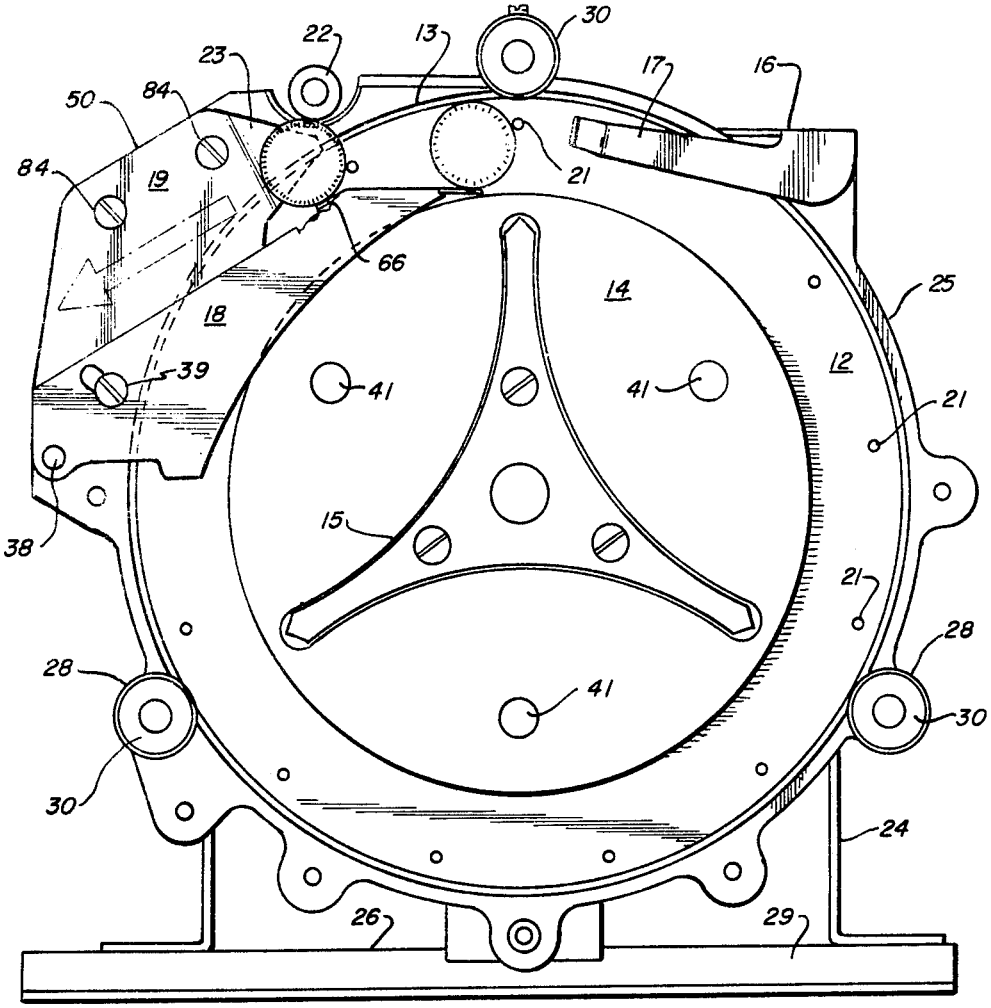
FIG. 4
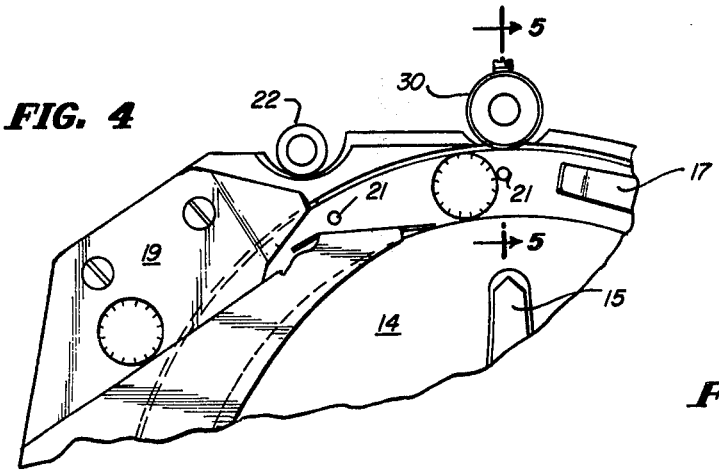
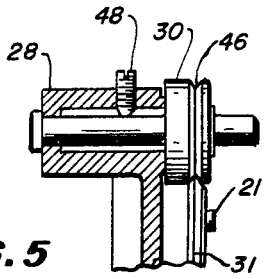
FIG. 5

FIG. 8
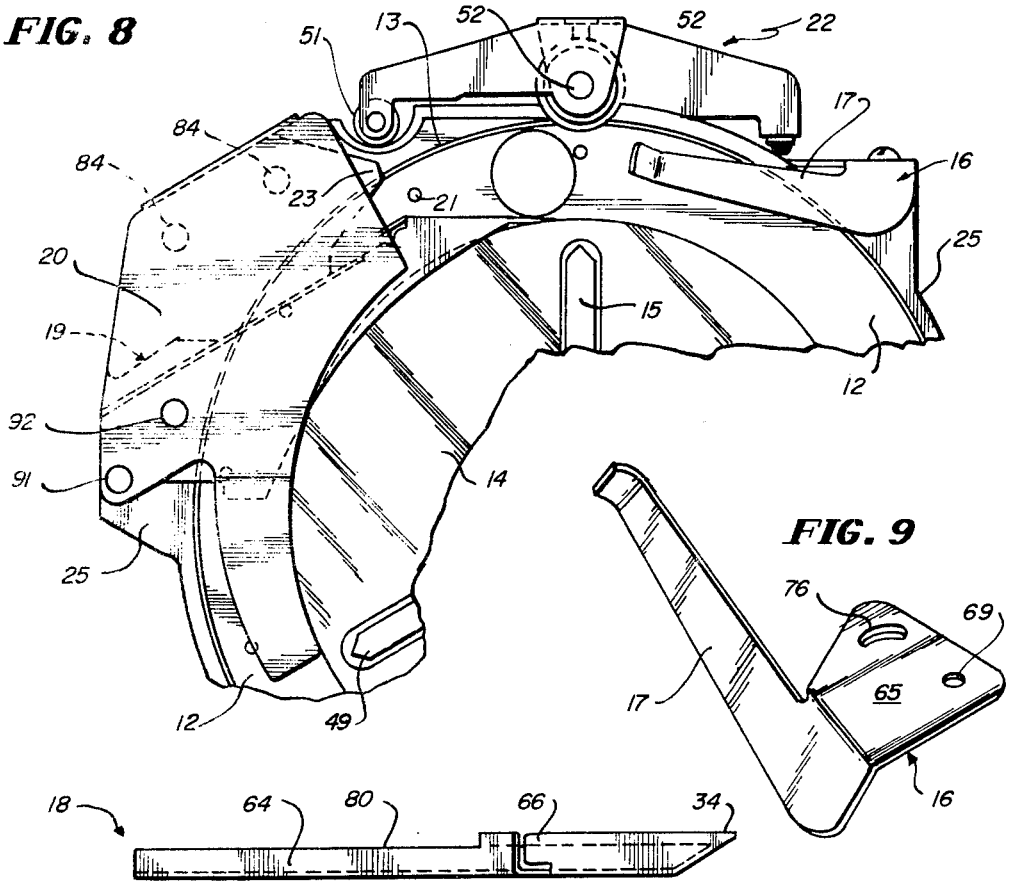
FIG. 9
FIG. 12
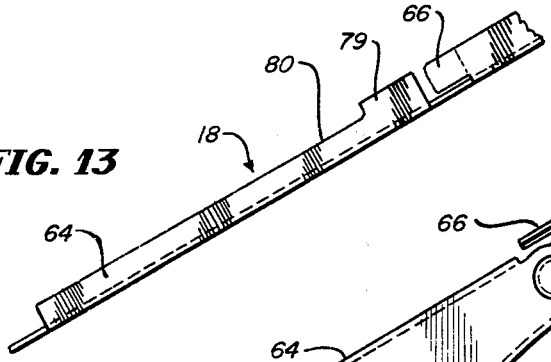
FIG. 13
FIG. 11
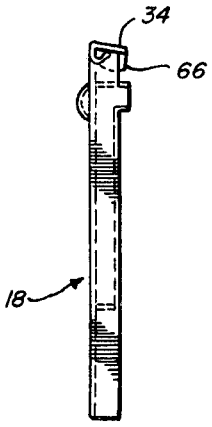
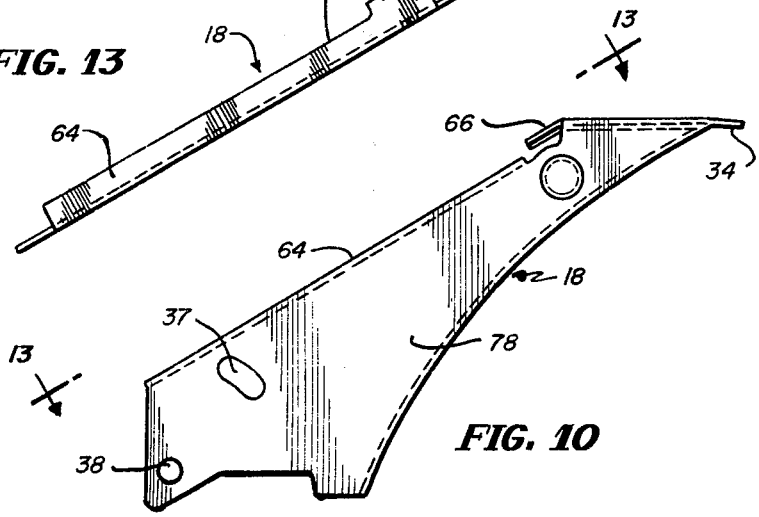
FIG. 10

FIG. 17
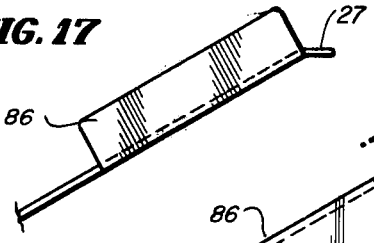
FIG. 15
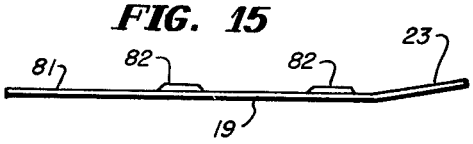
FIG. 14
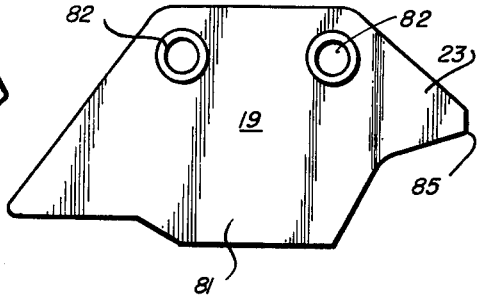
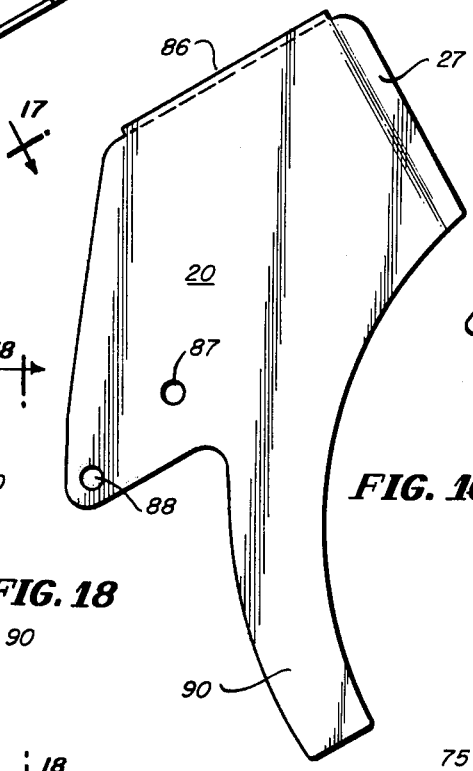
FIG. 16
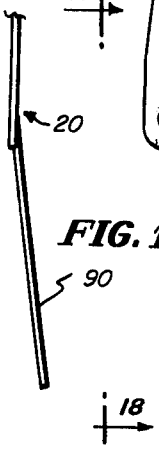
FIG. 18
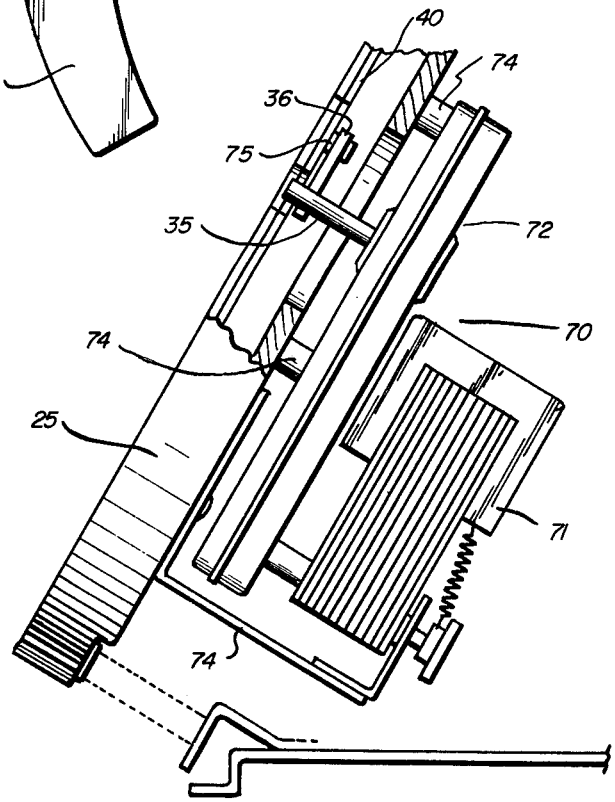
FIG. 19

HOPPER PAYOUT FOR VARIOUS COIN DENOMINATIONS

This is a continuing application of Ser. No. 384,624 filed Aug. 1, 1973, now U.S. Pat. No. 3,942,544 issued Mar. 9, 1976.

BACKGROUND OF THE INVENTION

1. Field of the Invention

The subject invention relates to hopper payout mechanisms, and more particularly those which are commonly used to deliver a preselected number of coins to a delivery chute. Primarily these units are employed in devices actuated for a game of chance. Such products appear classified in Patent Office Class 194, Sub-Class 2, amongst others.

2. Discussion of the Prior Art

U.S. Pat. No. 3,285,380 is illustrative of the prior art. As disclosed, the coin counter has a rotary member and delivery chute including a hopper. A positive drive, however, is provided at the center of the pin wheel, which precludes the maintaining of precise dimensional accuracies at the periphery of the pin wheel. In addition, the shelf wheel in combination with the pin wheel and wiper are permanently designed for specific coin denominations, that is, by diameter and thickness.

Where several coin counting installations are involved, for purposes of service, it becomes increasingly important to maintain spare hopper payout mechanisms adaptable for various coins involved. Where international trade is concerned, coin counting units must be capable of accommodating a wide variety of diameters and thicknesses. Most of the coin counting devices of the prior art require extensive modification, if not replacement for varying sizes of coins. For example, with United States coins separate hopper payout mechanisms are required for dimes, nickels, quarters, and half-dollars. Necessarily, a manufacturer contemplating export, must make even additional models in order to export for use with the wide variety of foreign coin denominations, thicknesses, and diameters.

SUMMARY

A hopper payout mechanism for various coin denominations is disclosed which is readily modified for use with a wide variety of coin sizes, both as to thickness and diameter. Anti-jamming features are provided in connection with the present invention, in addition to interchangeable elements designed for the accommodation of numerous coin diameters and thicknesses. A central crank type drive mechanism is employed with the pin wheel journalled at its periphery to thereby precisely position the pin wheel. The coin gutter at the bottom of the hopper widens progressively at a steadily increasing helical configuration to thereby relieve the tendency of the coins of various diameters and thicknesses to shingle at the bottom of the gutter and lower portion of the hopper. A coin wiper is positioned immediately ahead of the counter to insure that only the single coin is nested between two adjacent pins on the pin wheel, prior to engaging the pivotally adjustable knife. The delivery chute is provided with a cover plate and interior deflector designed to receive the coin when it is accelerated outwardly after being counted, and the counter returns to its preset position thereby accellerating the coin, and quickly prepositioning itself for further counting. To avoid overloading or spilling the hopper, the same is, along with the rotating of the mechanism, pivotally supported to a frame and yieldably adjustable so that it can be preselected set to bypass coins when a given quantity, determined imperically by weight, of coins are present within the hopper.

In view of the foregoing, it is a principal object of the present invention to provide a hopper payout mechanism for various coin denominations which can be, with a few relatively inexpensive parts, converted and adjusted for a wide variety of coin diameters and thicknesses.

Still another object of the present invention is to provide a hopper payout mechanism for various coin denominations which can be formed from a plurality of stampings and castings, thereby reducing costs, and yet because of the suspension and mounting of the rotating parts, precise dimensional accuracies can be maintained.

A further important object of the present invention is to provide a hopper payout mechanism for various coin denominations which requires only a small inventory of spare parts to render the same interchangeable for the various sizes of coins in the machines for which the hopper is intended.

Still another object of the present invention is to provide a hopper payout mechanism for various coin denominations which has jam-relieving characteristics irrespective of sizes of coins as exemplified by United States dimes, nickels, quarters, and half-dollars.

Not to be overlooked is an important object of the present invention to achieve all of the foregoing objectives in a unit which is designed to have inherent manufacturing economies.

DESCRIPTION OF DRAWINGS

Further objects and advantages of the present invention will become apparent as the following description of an illustrative embodiment proceeds in which:

FIG. 1 is a perspective view of the illustrative hopper payout.

FIG. 2 is an exploded enlarged perspective view of the principal rotating elements.

FIG. 3 is a front elevation in enlarged scale of the hopper payout mechanism with the hopper removed to show the principal rotating and orienting elements.

FIG. 4 is an enlarged broken view of the counting and pick-off portion of the hopper payout mechanism shown in FIG. 3, taken in enlarged scale.

FIG. 5 is a transverse broken sectioned view of the roller suspension of the pin wheel taken at section line 5-5 of FIG. 4.

FIG. 8 is an enlarged broken view of the counter mechanism.

FIG. 9 is an illustrative perspective view of the wiper.

FIG. 10 is a plan view of the knife.

FIG. 11 is a front view of the knife taken from the right hand portion of FIG. 10 and in the same scale.

FIG. 12 is a top view of the knife shown in FIG. 10.

FIG. 13 is an angled top view of the knife taken from the vantage point illustrated as 13—13 of FIG. 10.

FIG. 14 is a plan view of the deflector.

FIG. 15 is a top view of the deflector.

FIG. 16 is a plan view of the outlet cover.

FIG. 17 is a partial top view of the deflector cover taken from vantage point 17—17 of FIG. 16.

FIG. 18 is an end view of the deflector cover taken from vantage point 18—18 of FIG. 16.

FIG. 19 is an enlarged partially broken view of the drive mechanism illustrating the relationship between the motor, gear box, drive pin, and pin wheel.

DESCRIPTION OF THE PREFERRED EMBODIMENT

Figure 7:
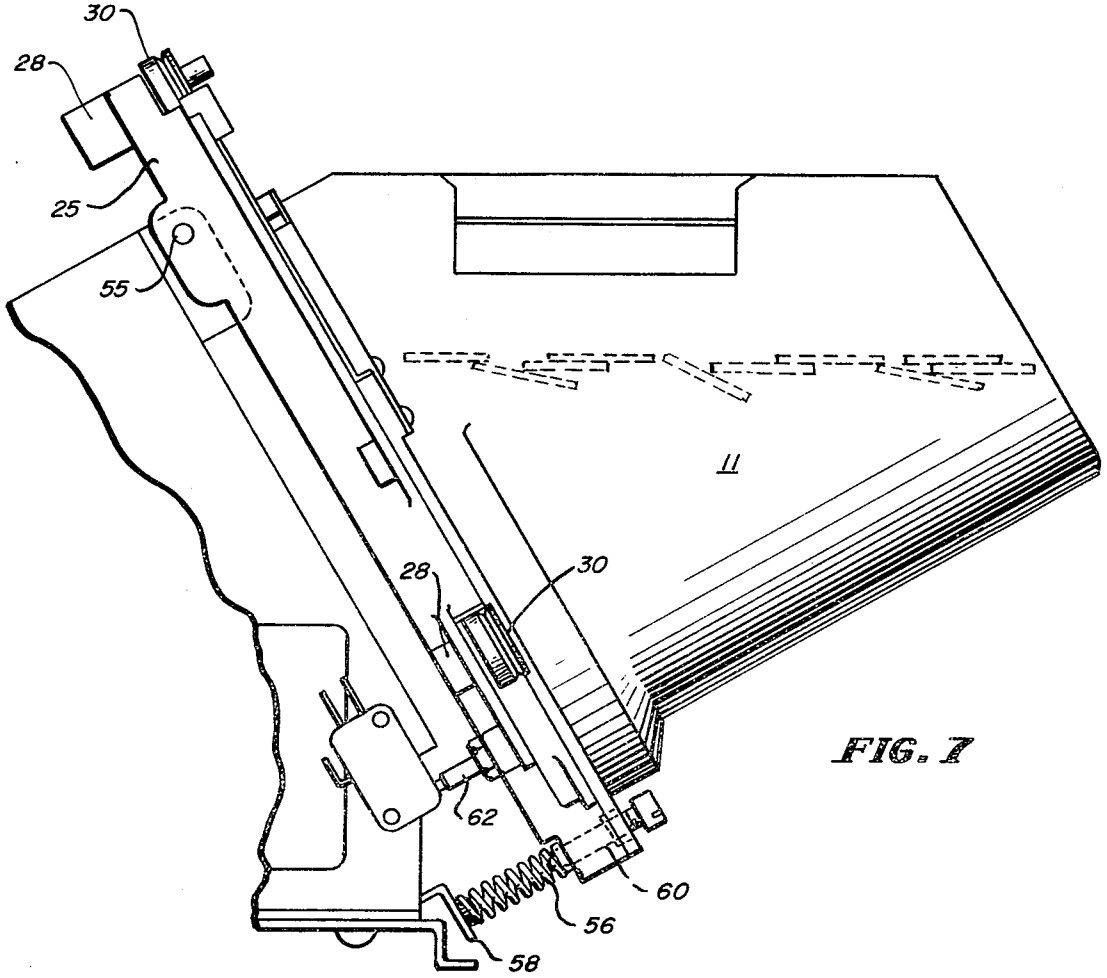
FIG. 7 is a side elevation of the hopper payout, partially broken in the drive mechanism portion, illustrating in phantom lines the level to which the coins are randomly permitted to collect, and showing also the yieldable means and pivotal suspension of the hopper provided to bypass coins when a preselected weight level of coins are in the hopper.

With reference to FIG. 1, it will be seen that the hopper payout for various coin denominations 10 includes a scoopshaped hopper 11, the same being mounted to a wheel housing 25 which, in turn, is supported on the side brackets 24, the latter being secured to the frame 26 which includes base rails 29 for sliding the hopper 10 in and out of the gaming machines for which it is intended to gather and pay out coins. Interiorly of the hopper 11, is a rotating pin wheel 12. The pin wheel 12 has a plurality of pins 21 located along its periphery to engage for counting and discharge, individual coins. The coins are supported between the pins 21 on a shelf wheel 14. An agitator 15, illustrated as a three-legged member, is positioned centrally on the shelf wheel 14 to agitate the coins within the hopper 11, and permit the same to become aligned in the gutter 32 of the hopper 11.

More specifically, as shown in FIG. 2, a cone spider 40 is positioned behind the pin wheel 12. The cone spider 40 has a plurality of cones 41, here shown being three in number, on yieldable cone supporting legs 42. When the cone spider 40 is secured to the rear portion of the pin wheel 12, and the shelf wheel 14 and its agitator 15 secured in the sequential relationship as shown in FIG. 2, the cones 41 penetrate the pin wheel cone holes 44 and the shelf wheel cone holes 45 to project through the face of the shelf wheel 14 as illustrated in FIGS. 1 and 3.

In operation the pin wheel 12, as shown in FIGS. 1 and 3, is rotated in the counter-clockwise direction. The coins pass first from the hopper 11 into the gutter 32. Because the pin wheel 12 and related elements are positioned at an angle (see FIG. 7), the coins are gravitationally urged into the gutter 32. The coins are then agitated by means of the agitator 15, and are engaged by the pins on the outer portion of the pin wheel 12. Coins can, of course, overlap on the periphery of the pin wheel 12 until, as shown in FIG. 3, they approach the two o'clock position. At this point, the wiper 16 engages any overlapping coins and wipes them back into the hopper 11. Those coins which pass beyond the top of the shelf wheel 14 are then engaged by the knife 18. The knife 18 includes an engaging point 34 at its forwardmost portion. As illustrated in FIG. 3, a coin is immediately atop the point 34 of the knife 18. The coin then proceeds across the knife 18 until it engages the yieldable counter 22. If the counter 22 is preset to pass five coins, after it has counted five coins it will turn off the drive mechanism for the hopper payout, and the last coin is accelerated by the yieldable action of the counter 22 into the coin discharge chute 50. The latter is made up of a coin deflector 19 in the interior portion which has a bevelled nose portion to engage and deflect the coin centrally. A cover plate 20, which is the outlet cover, overlies the coin deflector 19. The cover plate 20 is shown in FIG. 1, whereas the coin deflector 19 which is immediately behind the cover plate 20 is shown in FIG. 3. The coins then pass freely outwardly.

It will be appreciated that the knife 18 is secured at its pivot 38, and adjustably positionable by means of the securing mechanism 39, as shown in FIG. 3. Therefore, when varying diameter shelf plates 14 and agitators 15 are positioned on the pin wheel 12 to accommodate differing size coins, the knife 18 is moved by means of the securing mechanism 39 around the pivot 38, so that the point 34 will remain substantially tangential to the periphery of the shelf plate 14. To additionally assist in agitating the coins within the hopper 11, a coin spider 40 is positioned being the pin wheel 12 and shelf wheel 14 respectively, as shown in FIG. 2. The cones 41, as pointed out before, are yieldable secured to the cone spider 40 by means of the cone spider legs 42, and serve to yieldably assist the agitator 15 in connection with maintaining an even flow of coins into the gutter 32 and thereafter onto the pin wheel 12 between the pins 21.

In order to insure dimensional stability for the pin wheel 12 and its associated moving members, a knife edge 31 is formed at the periphery of the pin wheel 12, and is engaged by a plurality of rollers 30, each having a corresponding knife edge groove 46, as shown in greater detail in FIG. 5. In this construction, implemented by adjusting screw 48 as shown in FIG. 5, or a yieldable adjusting mechanism (not shown), permits a fine tuning of the support of the pin wheel 12 by means of the rollers 30, here shown as three in number. Each of the rollers 30 is preferably secured to a bearing mount 28 on the wheel housing 25. Roller or ball bearings provided for friction reduced rotation, and yet because of the adjusting screws 48 or their equivalent yieldable members, permit a precise positioning of the pin wheel 12. It will be particularly appreciated in connection with FIGS. 3 and 4 that the precision of positioning occurs between the upper roller 30 and the counter 22, since at this point the coin is transferred from the pin wheel 12 onto the point 34 and thence the knife 18 into the coin chute assembly 50.

Figure 6:
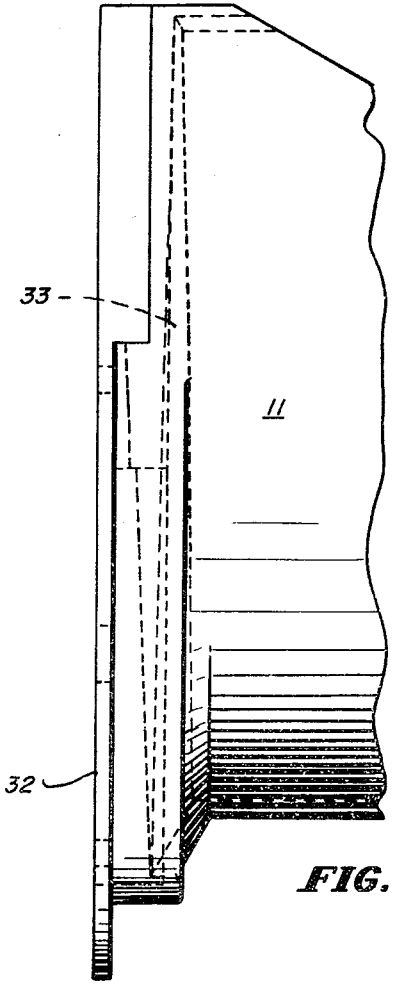
FIG. 6 is a partially broken transverse view of the hopper showing how the gutter enlarges progressively from bottom to top as coins are moved from the gutter and transferred onto the pin wheel.

As pointed out earlier, a very important aspect of the present invention is in the construction of the hopper 11, and more particularly, the gutter 32. By reference to FIG. 6, as well as the exterior of the hopper 11 as shown in FIG. 1, it will be seen that the gutter 32 as well as the gutter relief 33 has a progressively opening helical proportioning as the coins travel around the gutter 32 and are picked up by the pins 21 on the pin wheel 12. Because the pin wheel 12 is mounted with precision by means of the roller 30, a similar precision can be developed in the helical relief of the gutter 32 and its gutter relief bevelled portion 33 so that as coins may be shingled at the bottom of the hopper 11, as the pins 21 and agitator 15 along with the cones 41 stir the collection of coins within the hopper 11, shingling and jamming which may take place is relieved as the gutter helix of the gutter 32 and bevelled relief 33 progressively widen throughout the throat portion of the hopper 11.

In order to proportion the total number of coins within the hopper 11 to match the amounts of pay, as well as to avoid overloading of the hopper 11 which would cause jamming, the hopper 11 and its associated structure including the housing 25 are pivotally secured to the frame by means of pivots 55 located at the upper portion of the side brackets 24. At the lower portion of the wheel housing 25, it will be seen that a spring 56 has been provided secured to a spring bracket 58. The spring 56 bears in compression against the lower portion of the wheel housing 25, and by means of a spring preloading screw 60, the compressive load on the spring 56 may be varied. Thus, when a sufficient weight of coins, shown in phantom in FIG. 7, has been arrived at, the weight of the coins pivotting within the hopper 11 around the pivots 55 will overcome the loading of the spring 56, and the frame 25 with its associated loaded hopper 11 will pivot in a clockwise direction, as shown in FIG. 7, around the pivots 55. This pivotal action actuates a switch 62 which in turn actuates a by-pass (not shown) to divert coins from the host device from the hopper 11 directly to the permanent coin chute 50 provided in the host.

As shown in FIG. 8, the counter 22 includes a counter wheel 51, and a pivot 52 along with an actuating member 54 which in turn is connected to the various counting structures, whether electronic or mechanical, provided in the host device. The counter is provided with yieldable means of varying orientations and proportions, so that as a coin engages the counter wheel 51, positioned at a space between the base of the counter wheel 51 and the upper edge of the shelf wheel 14 to positively engage a coin, upon passing the counter wheel 51, not only has a count been made, but the counter wheel 51 has been "cocked" to impart some velocity to the coin after the same has been counted and is forwarded to the delivery chute 50. This provides the additional function of the counter assembly 22 of accelerating the coins through the chute 50, and avoiding jams and piling within the chute 50.

The knife 18, as shown in FIG. 9, includes the tapered point 34, and in addition the knife chute base portion 64 which defines the bottom portion of the chute 50. It will also be noted that the point 34 has a depending by-pass 66 which is oriented slightly above to the chute base 64. This further assists in accelerating the travel of the coin within the chute 50, after passing the counting mechanism 22 (see particularly the upper left hand portion of FIGS. 3 and 4).

In addition, the preconditioning wiper 16 shown in FIG. 9 has a tapered and yieldable finger 17 which is positioned to closely tangentially engage the pin wheel 12, and thereby insure that any coins apart from one thickness in the space between adjacent pins 21 are yieldably urged back into the hopper 11.

An alternative but also useful function is provided on the deflector 19, where a deflector tongue 23 is provided at its lead portion to approximately contact the periphery of the pin wheel 12 in the tongue recess 13, and in all events to engage the lead edge of a coin as the coin is passing beyond the counter mechanism 22 and over the bypass 66 of the knife mechanism 18. This structure is shown particularly in the view appearing in FIG. 8. The tongue portion 23 of the deflector 19 is proportioned so that its lower corner rides within a recess or offset 13 at the periphery of the pin wheel 12. Thus, as shown in FIG. 3, the tongue 23 is behind the coin, thereby avoiding the possibility of jamming, or the front edge of the tongue 23 contacting the edge of the coin rather than slipping beneath it to deflect it forwardly prior to passing down the chute 50. The outlet cover 20 is also shown in FIG. 8, where it will be seen that the outlet cover 20 has a gate member 27 which, in conjunction with the tongue 23 of the deflector 19, defines a pair of funnel-like converging members at the opening to the chute assembly 50. Thus, any coins which are deflected in a skewed direction after passing the counter 22 are urged back into alignment for accelerated discharge through the chute 50 as previously described.

The drive assembly 70 is shown in FIG. 19. There it will be seen that the drive assembly 70 preferably includes an electric motor 71, coupled with a motor brake 72 and gear box. The gear box has, extending from its drive-in portion, a drive shaft 35 and a drive pin 36. As described above, the drive pin 36, when the motor is operative and rotates the drive shaft 35, engages the drive pad 75 on the cone spider 40. The cone spider 40 is provided with three such drive pads 75, so that during assembly or interchange, precise positioning is not critical. Further to be noted are the motor mounts 74 which are secured to the wheel housing 25, thereby additionally assuring precise alignment of the drive mechanism, although tolerances can be permitted because of the crank pin type drive provided through the drive shaft 35 and the drive pin 36 against the drive pad 75.

Further additional details of construction will be observed in FIG. 2 where it will be seen that the agitator 15 is secured into position by means of screws 61 and at matching threaded holes in both the shelf wheel 14 and pin wheel 15. Bent ends 49 are provided at the ends of the agitator 15 and are nestingly received within the additional holes provided therefor in the shelf wheel 14. These holes are designated by reference numberals 68 in FIG. 2. The cone spider 40 is secured beneath by means of cone spider screws 59 into the rear portion of the pin wheel 12. It will be further appreciated that because the pin wheel 12 may be formed of a stamping, the pins 21 may be formed in the same stamping operation by means of pin forming members in the die. This insures precision in the formation of the pins 21 as well as inexpensive formation of the same. As shown in this unit, there are 16 pins spaced at equidistant radial spacings about the pin wheel 12.

For design purposes, the hopper gutter has a fixed 7.5 inches diameter (that portion concentric with the pin wheel) and fixed pin locations as discussed. Necessarily, this diameter can vary depending upon designed capacity and, thus, the 7.5 inches recited is primarily for illustration. The diameter of the shelf wheel A is then determined by the following formula:

$$A = B - (2d + 2t\ .040)$$

where the following definitions are applied:

A: shelf wheel diameter, B: 7.500"

d: coin diameter, t: coin thickness

The other dimensions for the agitator 15, knife 18, and remaining parts are all proportioned to depend upon the formula for determining the diameter of the pin wheel as set forth above. It will be appreciated that because the entire unit is mounted on a base 26 having flanking rails 29, it can be readily inserted and removed from a host machine. Conveniently, at the option of the manufacturer, a handle may be provided for this purpose on either of the side brackets 24.

Specific details of the wiper 16 appear in FIG. 9 on the perspective view where it will be seen that a wiper mount 65 appears as an offset member from the wiper finger 17. A mounting hole 69 is provided, along with a slotted hole 76 which permits the wiper finger 17 to be swung for the proper spacing adjacent the pin wheel 12 to accommodate thicker or thinner coins depending upon which is being passed through the hopper payout.

The specifics of the knife 18 are shown in FIGS. 10 thru 13 inclusive. There it will be seen that the knife 18 has a body 78, from which the chute base 64 depends. Pointed out specifically in FIGS. 12 and 13 is the pin by-pass recess 80 which is an undercut portion of the chute base 64 "downstream" from the lead portion 79 of the chute base 64. To be further noted in FIG. 11 is the offset angle of the knife point 34, and the by-pass 66 to yieldably urge the coins toward the pin wheel 12, rather than away from the same as the coin is passing onto the knife point 34, for its subsequent travel down the by-pass 66 and the chute base 64. As pointed out earlier, a pivot 38 (see FIG. 10) and arcuate slot 37 are provided in the body 78 of the knife 18, so that the positioning of the knife 18 against the shelf wheel 14 for varying size coins may be accomplished by means of the securing mechanism 39, illustrated in FIG. 3 and described above.

Specifics of the deflector 19 are shown in FIGS. 14 and 15 where it will be seen that the same includes a body 81, along with the tongue 23, and mounting holes 82 to receive the mounting screws 84, as illustrated in FIG. 3 and shown in dotted lines in FIG. 8. As pointed out earlier, the front lower corners 85 of the tongue 23 is positioned to approximately contact the tongue recess 13 on the periphery of the pin wheel 12, to thereby avoid jamming or contact engagement with the coin. This arrangement tends to insure that the coin will deflectingly engage the tongue 23 for its further delivery into the chute 50. In order to completely define the balance of the chute 50, along with the deflector 19 and the chute base 64 of the knife 18, a cover plate 20 is provided as shown more specifically in FIGS. 16, 17 and 18. There it will be seen that the cover plate 20 has its lead edge optionally bent outwardly to define a gate 27. In addition, a cover top 86 is defined by a flange perpendicular to the body portion, and of course cooperates with the chute base 64 and the sides of the deflector 19 and cover plate 20 to define the chute with an open mouth defined by the gate 27 and tongue 23. Also to be noted is that the cover plate is provided with a pivot hole 88 and a slotted pivot hole 89 so that the same may be, as shown in FIG. 8, rotated adjustably along with the knife 18 when varying sized shelf wheels 14 are employed. The trailer 90 of the cover plate 20 is bent slightly outwardly as shown in FIG. 18 to accommodate any coins which may be at that height in the hopper, and deflect the same from the pin wheel 12 at that point.

In review, it will be seen that a hopper payout for various coin denominations 10 has been shown and described in which simple adjustments, and inexpensive replacement spare parts, make it possible to accommodate a wide variety of coin denominations including thickness and diameter. By replacing the shelf wheel 14 and agitator 15, the same being done by the removal of the three mounting screws 61, a different shelf wheel diameter and, where required, different size agitator 15 may be inserted. Thereafter, the only additional adjustment to be made by the operator is to loosen the securing mechanism 39 for the pivotal knife 18, and pivot the same around pivot point 38 until the knife edge wiper 16 is immediately adjacent the periphery of the shelf wheel 14 in place. It will be further noted that the cones 41 are positioned on the legs 42 of the cone spider 40 so that even as the shelf wheel 14 is reduced in diameter to accommodate larger coins, the position and orientation of the yieldably secured cones 41 remains the same. The same is true with regard to the hopper gutter 32, and also the wiper 16, since the wiper finger 17 is positioned immediately atop the pins 21, and the latter will always be engaging and urging the coins forwardly in the space between the adjacent pins 21. The parts such as the pin wheel 12 and shelf wheel 14 as well as agitator 15 and cone spider 40 may all be made of stampings, thereby significantly reducing costs. In addition, the side brackets 24 as well as the base 26 can be formed of stampings. Little or no machine parts are required, and because of the precision dimension insured by means of the three-point suspension roller orientation of the pin wheel 12, precision and dimension in the sensitive area between the knife pickup and chute 50 can be maintained under operating conditions.

Although particular embodiments of the invention have been shown and described in full here, there is no intention to thereby limit the invention to the details of such embodiments. On the contrary, the invention is to cover all modifications, alternatives, embodiments, usages and equivalents of a HOPPER PAYOUT FOR VARIOUS COIN DENOMINATIONS as fall within the spirit and scope of the invention, specification and the appended claims.

We claim:

1. In a coin handling apparatus of the type having a coin hopper with a coin outfeed passage directing coins gravitationally in bulk against the lower face portions of an inclined rotating coin transport disc operative to pick up and transport coins seriatim to a region in the upper level of disc travel, the improvement comprising:

means supporting said disc for rotation in a fixed plane of inclination confronting said outfeed passage by antifriction bearing means including at least three rotative bearing members respectively supportively engaging with peripheral margins of the disc at points spaced apart thereabout substantially equidistantly, at least two of said bearing members being situated adjacent the lower portion of said disc which is proximate to said outfeed passage and an eccentrically-acting loading effect of bulk coins pressing against the disc thereat, another said bearing member being situated in the region of said upper level of disc travel, whereby the interengagement between said bearing members and peripheral portions of the disc is such that the imbalanced loading effect of the bulk coin mass against one region of the disc is alleviated to constrain the disc for rotation in a fixed plane relative to the hopper as aforesaid.

2. In the coin handling apparatus of claim 1, means for rotating said disc including a motor having a drive shaft means impositively coupled in its central region with said disc to apply driving torque thereto, whereby the disc is free from all supportive engagement and attachment in said central region.

3. In the coin handling apparatus of claim 1, said bearing means comprising three anti-friction bearings of the ball bearing type.

4. In the coin handling apparatus of claim 3, means for rotating said disc including a motor having a drive shaft means impositively coupled in its central region with said disc to apply driving torque thereto, whereby the disc is free from all supportive engagement and attachment in said central region.

5. In the coin handling apparatus of claim 1,
said bearing means comprising anti-thrust roller bearing types each including a rotatable bearing member having supportive bearing engagement with a peripheral margin of said disc.

6. In the coin handling apparatus of claim 5,
means for rotating said disc including a motor having a drive shaft means impositively coupled in its central region with said disc to apply driving torque thereto, whereby the disc is free from all supportive engagement and attachment in said central region.

7. In a coin counting and delivery device of the type comprising a coin transport disc rotated in an inclined plane and having coin receiving means on its face to pick up coins gravitatingly fed in bulk against its lower regions and transport such coins serially to a counting and delivery station at the upper levels of the disc transit, the improvement comprising:
means supporting the disc for rotation in a predetermined fixed plane,
said supporting means including bearings operative to resist eccentrically-acting pressure of infeeding coins against the lower region of the disc,
said bearings comprising a first anti-friction roller member having rotational interfit with an upper peripheral margin of the disc adjacent to said counting and discharge station,
additional anti-friction roller members respectively supportingly engaging the lower peripheral margins of the disc adjacent to the region thereof which is exposed to the pressure of infeeding coins as aforesaid at respective positions which are on opposite sides of a radius of the disc lying in an approximately vertical plane,
means spacing the interfit of the respective roller members of a character to constrain the disc to rotate in a predetermined fixed plane which is at an angle to the general direction of thrust of the infeeding coins against the disc.

8. the coin counting and delivery apparatus of claim 7 further including means for rotating the disc including an electric motor having a drive shaft, and means drivingly coupling said shaft with said disc but free of supportive engagement therewith.

9. In a coin counting and delivery device of the type comprising a coin transport disc rotated in an inclined plane and having coin receiving means on its face to pick up coins gravitatingly fed in bulk against its lower regions and transport such coins serially to a counting and delivery station at the upper levels of the disc transit, the improvement comprising:
means supporting the disc for rotation in a predetermined fixed plane,
said supporting means including bearings operative to resist eccentrically-acting pressure of infeeding coins against the lower region of the disc,
said bearings comprising a first anti-friction roller member having rotational interfit with an upper peripheral margin of the disc adjacent to said counting and discharge station,
additional anti-friction roller members respectively supportingly engaging the lower peripheral margins of the disc adjacent to the region thereof which is exposed to the pressure of infeeding coins as aforesaid at respective positions which are on opposite sides of a radius of the disc lying in an approximately vertical plane,
means spacing the interfit of the respective roller members of a character to constrain the disc to rotate in a predetermined fixed plane which is at an angle to the general direction of thrust of the infeeding coins against the disc,
and means for rotating said disc including a motor having a drive shaft means impositively drivingly coupled to said disc, its central region to apply drive torque thereto, whereby the disc is free from all supportive engagement and attachment in said central region and is positively supported about its periphery.

10. In the coin handling apparatus of claim 9,
said bearing means comprising three anti-friction bearings of the ball bearing type.

11. In the coin handling apparatus of claim 9,
said bearing means comprising anti-thrust roller bearing types each including a rotatable bearing member having supportive bearing engagement with a peripheral margin of said disc.

* * * * *

UNITED STATES PATENT OFFICE

CERTIFICATE OF CORRECTION

Patent No. 4,036,242 Dated July 19, 1977

Inventor(s) Charles T. Breitenstein and Frank G. Nicolaus

It is certified that error appears in the above-identified patent and that said Letters Patent are hereby corrected as shown below:

Item /63/ should read --Continuing application of Ser. No. 384,624, Aug. 1, 1973, Pat. No. 3,942,544.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*